US010998610B2

(12) United States Patent
Nie et al.

(10) Patent No.: US 10,998,610 B2
(45) Date of Patent: May 4, 2021

(54) ELECTRONIC DEVICE, METHOD FOR ADJUSTING OPERATING FREQUENCY BAND OF ANTENNA OF ELECTRONIC DEVICE

(71) Applicant: BEIJING XIAOMI MOBILE SOFTWARE CO., LTD., Beijing (CN)

(72) Inventors: Fan Nie, Beijing (CN); Bingxiao Wang, Beijing (CN); Linchuan Wang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/425,920

(22) Filed: May 29, 2019

(65) Prior Publication Data

US 2019/0372195 A1 Dec. 5, 2019

(30) Foreign Application Priority Data

May 31, 2018 (CN) ..... 201810551275.2

(51) Int. Cl.
*H01Q 1/22* (2006.01)
*H01Q 5/378* (2015.01)
(Continued)

(52) U.S. Cl.
CPC ..... *H01Q 1/22* (2013.01); *H01Q 1/50* (2013.01); *H01Q 5/378* (2015.01); *H01Q 9/42* (2013.01)

(58) Field of Classification Search
CPC ..... H01Q 13/10; H01Q 1/50; H01Q 1/36; H01Q 5/50
(Continued)

(56) References Cited

U.S. PATENT DOCUMENTS 6,529,749 B1 * 3/2003 Hayes et al.
6,662,028 B1 * 12/2003 Hayes et al.
(Continued)

FOREIGN PATENT DOCUMENTS

CN 1122534 A 5/1996
CN 106229624 A 12/2016
(Continued)

OTHER PUBLICATIONS

Extended European Search Report in Application No. 19176463, dated Oct. 9, 2019.
(Continued)

*Primary Examiner* — Jany Richardson
(74) *Attorney, Agent, or Firm* — Syncoda LLC; Feng Ma

(57) ABSTRACT

An electronic device includes a feeding point, a first switch module, a second switch module, a first connecting portion, a second connecting portion and a third connecting portion; the feeding point is connected to an end of the first sub-bezel through the first connecting portion; a first end of the first switch module is connected to the second partition through the second connecting portion, and a second end of the first switch module is grounded; a connection position between the second connecting portion and the second partitioning is adjacent to the feeding point; and a first end of the second switch module is connected to the first sub-bezel through the third connecting portion, and a second end of the second switch module is grounded.

18 Claims, 8 Drawing Sheets

(51) Int. Cl.
*H01Q 1/50* (2006.01)
*H01Q 9/42* (2006.01)

(58) Field of Classification Search
USPC ..... 343/767, 900, 905, 906, 907, 908
See application file for complete search history.

(56) References Cited

U.S. PATENT DOCUMENTS

| | | | |
|---|---|---|---|
| 9,728,854 | B2 * | 8/2017 | Kim et al. |
| 10,381,721 | B2 * | 8/2019 | Wang et al. |
| 2016/0164168 | A1 | 6/2016 | Choi et al. |
| 2016/0365623 | A1 | 12/2016 | Kim et al. |
| 2017/0237150 | A1 | 8/2017 | Soh et al. |
| 2017/0244818 | A1 | 8/2017 | Kim et al. |
| 2017/0374182 | A1 | 12/2017 | Lee et al. |

FOREIGN PATENT DOCUMENTS

| | | | |
|---|---|---|---|
| CN | 106229625 | A | 12/2016 |
| CN | 107317113 | A | 11/2017 |
| CN | 107331979 | A | 11/2017 |
| CN | 107834205 | A | 3/2018 |

OTHER PUBLICATIONS

CN First Office Action in Application No. 201810551275.2, dated Nov. 29, 2019.

* cited by examiner

ELECTRONIC DEVICE, METHOD FOR ADJUSTING OPERATING FREQUENCY BAND OF ANTENNA OF ELECTRONIC DEVICE

CROSS-REFERENCE TO RELATED APPLICATION

This application claims priority to Chinese Patent Application No. 201810551275.2, filed on May 31, 2018, the disclosure of which is incorporated herein by reference in its entirety.

BACKGROUND

At present, due to the consideration of aesthetics and other factors, the outer casing of an electronic device is typically made of metal or ceramic. In addition, a metal bezel is adopted for the electronic device, so that the electronic device shows a metallic texture. These features provide increased structural strength and aesthetic appearance of the electronic device. The main antenna of the existing electronic device is usually implemented by a large-area Laser Direct Structuring (LDS) type antenna or a Flexible Printed Circuit (FPC) type antenna.

SUMMARY

The present disclosure relates to the field of antenna technologies, and more particularly, to an electronic device and a method for adjusting an operating frequency band of an antenna of an electronic device.

An objective of the present disclosure and corresponding disclosure is to describe and illustrate an electronic device and a method for adjusting an operating frequency band of an antenna of an electronic device, so as to overcome defects of related technologies.

In an aspect, there is provided an electronic device having a casing, the casing in this embodiment can include: a metal bezel, a first partition and a second partition. In such embodiments, the first partition and the second partition are configured to divide the metal bezel into a first sub-bezel and a second sub-bezel. As will be discussed in more detail below and illustrated in the figures the first sub-bezel can be located between the first partition and the second partition; wherein the electronic device further includes: a feeding point, a first switch module, a second switch module, a first connecting portion, a second connecting portion and a third connecting portion.

In some alternative embodiments, the feeding point can be connected to an end of the first sub-bezel through the first connecting portion;

In some alternative embodiments, a first end of the first switch module can be connected to the second partition through the second connecting portion, and a second end of the first switch module can be grounded; a connection position between the second connecting portion and the second partitioning can be provided near the feeding point;

a first end of the second switch module can be connected to the first sub-bezel through the third connecting portion, and a second end of the second switch module can be grounded;

wherein, the feeding point, the first connecting portion, the first sub-bezel, the third connecting portion and the second switch module form an inverted F antenna; the second sub-bezel, the second connecting portion and the first switch module form a parasitic antenna of the inverted F antenna.

In some embodiments, the first switch module includes a first switch, a first inductor, and a first capacitor;

a first end of the first switch is connected to the second connecting portion;

a second end of the first switch is connected to a first end of the first inductor, and a second end of the first inductor is grounded;

a third end of the first switch is connected to a first end of the first capacitor, and a second end of the first capacitor is grounded.

In some embodiments, the first switch module further includes a second inductor; a first end of the second inductor is connected to the first end of the first switch, and a second end of the second inductor is grounded.

In some embodiments, the second switch module includes a second switch, a second capacitor, a third inductor, and a fourth inductor;

a first end of the second switch is connected to the third connecting portion;

a second end of the second switch is connected to a first end of the third inductor, and a second end of the third inductor is grounded;

a third end of the second switch is connected to a first end of the second capacitor, and a second end of the second capacitor is grounded;

a fourth end of the second switch is connected to a first end of the fourth inductor, and a second end of the fourth inductor is grounded.

In some embodiments, the second switch module further includes a fifth inductor; a first end of the fifth inductor is connected to the first end of the second switch, and a second end of the fifth inductor is grounded.

In some embodiments, the electronic device further includes a bandwidth optimization module; a first end of the bandwidth optimization module is connected to the feeding point, and a second end of the bandwidth optimization module is grounded.

In some embodiments, the bandwidth optimization module includes at least a variable capacitor; a first end of the variable capacitor is connected to the feeding point, and a second end of the variable capacitor is grounded.

In some embodiments, the electronic device further includes a processor and a memory for storing processor executable instructions; the processor is connected to control ends of the first switch module and the second switch module;

The processor is configured to execute the executable instructions stored in the memory to adjust a switch state of the first switch module and the second switch module through corresponding control ends.

In a second aspect of an embodiment of the present disclosure, a method for adjusting an operating frequency band of an antenna of an electronic device can be provided, the method including: determining service type required to be performed; determining an operating frequency band of an inverted F antenna and a parasitic antenna corresponding to the service type; determining a switch state of a first switch module and a second switch module according to the operating frequency band; and adjusting the first switch module and the second switch module to corresponding switch state.

In some embodiments, the determining a switch state of a first switch module and a second switch module according to the operating frequency band includes the following information.

If the operating frequency band is a first frequency band, it is determined that a first switch in the first switch module is connected to a first inductor, and a second switch in the second switch module is connected to a second capacitor.

If the operating frequency band is a second frequency band, it is determined that the first switch is connected to the first inductor, and the second switch is disconnected.

If the operating frequency band is a third frequency band, it is determined that the first switch is connected to the first inductor, and the second switch is connected to a third inductor.

If the operating frequency band is a fourth frequency band, it is determined that the first switch is connected to the first inductor and the second switch is connected to a fourth inductor.

If the operating frequency band is a fifth frequency band, it is determined that the first switch is simultaneously connected to the first inductor and a first capacitor, and the second switch is connected to the second capacitor.

If the operating frequency band is a sixth frequency band, it is determined that the first switch is simultaneously connected to the first inductor and the first capacitor, and the second switch is connected to the fourth inductor.

In some embodiments, the method further includes: adjusting, according to the operating frequency band, an impedance value of a bandwidth optimization module to optimize radiation efficiency of the parasitic antenna and the inverted F antenna.

The technical solution provided by embodiments of the present disclosure can include the following beneficial effects.

By providing the first switch module and the second switch module in the embodiment of the present disclosure, the second switch module, the feeding point, the first connecting portion, the first sub-bezel and the third connecting portion form the inverted F antenna and the second sub-bezel, the second connecting portion and the first switch module form the parasitic antenna of the inverted F antenna. By adjusting the switch states of the first switch module and the second switch module, the inverted F antenna and the parasitic antenna can cover the frequency band required by the electronic device. It can be seen that LDS and FPC are not needed in this embodiment, so that the performance of the main antenna is not affected by the reduction of the forehead area and the material of the casing.

It should be understood that the above general description and the detailed description below are merely exemplary and explanatory, and do not limit the present disclosure.

BRIEF DESCRIPTION OF THE DRAWINGS

The accompanying drawings herein, which are incorporated in and constitute a part of this specification, illustrate embodiments consistent with the present disclosure and, together with the description, serve to explain the principles of the present disclosure, in which.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

The inventors of the present disclosure have recognized that a main antenna of typical existing electronic devices are usually implemented by large area LDS antenna or FPC antenna; however, as electronic devices are developed to have increasingly large screens, their forehead areas gradually becomes smaller, resulting in the reduction of the main antenna clearance area. When the main antenna pattern becomes small, the performance of the main antenna is easily affected by the material of the casing of the electronic device.

For an electronic device using casing having a metal bezel, the embodiment of the present disclosure provides a solution to solve the above problem. In particular one such solution is illustrated in FIG. 1, which illustrates a schematic diagram of a main antenna of an electronic device according to an exemplary embodiment.

Figure 1:
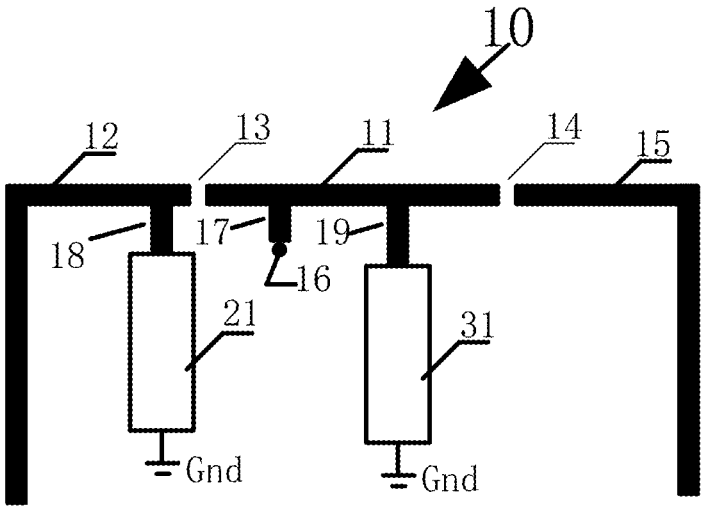
FIG. 1 illustrates a schematic diagram of a main antenna of an electronic device according to an exemplary embodiment.

Referring to FIG. 1, an electronic device includes a casing having at least a metal bezel, a first partition and a second partition. The first partition 13 and the second partition 14 divide the metal bezel into a first sub-bezel 11 and a second sub-bezel 12. Illustrated here is also a third sub-bezel 15, but this portion can also be part of or a continuation of the second sub-bezel 12 wrapping around an opposing side of the electronic component, or can also be separate from the second sub-bezel 12. Since the role of the sub-bezel 15 is not reflected in the present disclosure, it will not be discussed in more detail herein.

With continuing reference to FIG. 1, in an embodiment of the present disclosure, the electronic device 10, as illustrated herein, can include a first switch module 21, a second switch module 31, a feeding point 16, a first connecting portion 17, a second connecting portion 18 and a third connecting portion 19. As illustrated here, the feeding point 16 can be connected to the first sub-bezel 11 through the first connecting portion 17. Also illustrated here a first upper switch end, which can be located at an upper portion of the first switch module 21, of the first switch module 21, as shown in FIG. 1, can be connected to the second partition 12 through the second connecting portion 18 Further, a second lower switch end of the switch module 21, which can be located at a lower portion of the first switch module 21 of the first switch module 21, as shown in FIG. 1, can be grounded (Gnd). Additionally, a connection position between the second connecting portion 18 and the second partition can be provided near to the feeding point 16. In addition, as illustrated here, a second upper switch end, which can be located at an upper portion of the second switch module 31 of the second switch module 31, as shown in FIG. 1, can be connected to the first sub-bezel 11 through the third connecting portion 19, and a second lower switch end, which can be located at a lower portion of the second switch module 31 of the second switch module 31 is grounded (Gnd), as shown in FIG. 1.

Figure 2:
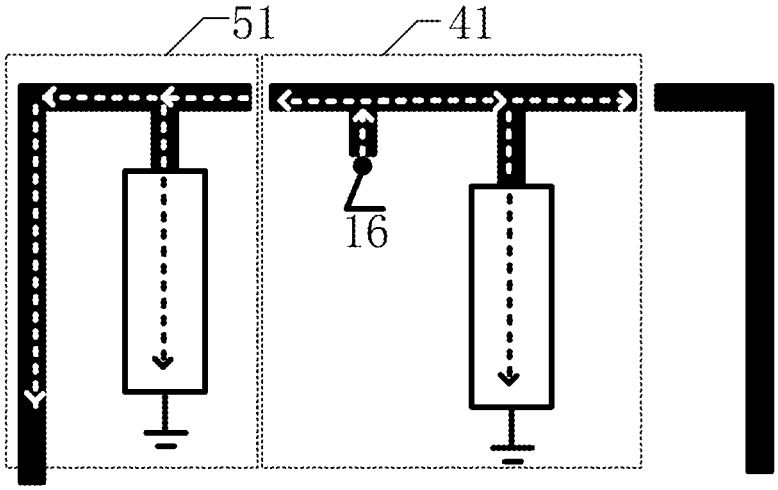
FIG. 2 illustrates a schematic circuit diagram of an antenna of the electronic device shown in FIG. 1.

FIG. 2 illustrates a schematic circuit diagram of an antenna of the electronic device shown in FIG. 1. It should be noted that, in order to make FIG. 2 clearer, some reference numerals are deleted, and those skilled in the art will recognize the reference numerals and names of each part in FIG. 2 by referencing between FIG. 1 and FIG. 2. Now, particularly referring to FIG. 2, the feeding point 16, the first connecting portion 17, the first sub-bezel 11, the third connecting portion 19, and the second switch module 31 constitute an inverted F antenna 41. In the inverted F antenna 41, the dotted line, excluding an arrow, represents a switch of the letter 'F', wherein the first sub-bezel 11 constitutes a trunk portion of the letter 'F', the third connecting portion 19 and the branch of the second switch module 31 constitute the first horizontal line or upper branch portion of the letter 'F', and the feeding point 16 and the first connecting portion 17 constitute the second horizontal line or branch portion of the letter 'F'. The dotted line, including an arrow, indicates the current flow direction when the inverted F antenna 41 is in operation. In other words, the current flows through the feeding point 16 to the first connecting portion 17, and is divided into two paths after passing through the first sub-bezel 11. In such an instance, the first path of current flows to the ground (Gnd) after passing through the second switch module 31, and the second path of current flows to the first partition 13.

It should be noted that, in this embodiment, the operating frequency bands of the inverted F antenna 41 are, for exemplary purposes, provided in the frequency band B12, GSM850, GSM900+B3, or in other words, the low frequency bands.

With continuing reference to FIG. 2, the second sub-bezel 12, the second connecting portion 18, and the first switch module 21 constitute what is often referred to as a parasitic antenna 51 of the inverted-F antenna 41. The second path of current of the inverted F antenna 41 is coupled to the second sub-bezel 12 through the slot, i.e., the first partition 13, and is divided into two paths, the first path of current flows to the ground (Gnd) after passing through the second connecting portion 18 and the first switch module 21. Then the second path of current continues to flow left and down along the second sub-bezel 12 to the metal back shell or the common end, i.e., the ground (Gnd).

It should be noted that, in this embodiment, the operating frequency bands of the parasitic antenna 51 are, for exemplary purposes, provided in what are commonly referred to as the middle frequency bands (1.85~2.17 GHz), and the high frequency bands B40 and B41. In other words, the operating frequency band of the parasitic antenna 51 is the middle and high frequency bands.

In the present embodiment, the first switch module 21 and the second switch module 31 can adjust an impedance value by switching their respective positions. In this way, the inverted F antenna 41 can emit at 700 MHz and 900 MHz frequency bands respectively, and the frequency band of 1700 MHz-2700 MHz can be covered by the inverted F antenna 41 and the parasitic antenna 51 thereof. In other words, the main antenna of the electronic device in this embodiment can achieve full coverage of the emission frequency from 700 MHz to 3 GHz, and satisfy the requirement of emission of any necessary frequency bands of the electronic device.

It can be seen that the main antenna of the electronic device in this embodiment does not need to be provided Laser Direct Structuring (LDS) and Flexible Printed Circuits (FPC). As such, the present embodiments of the present disclosure can utilize other antenna technologies thereby avoiding the problem that the LDS and the FPC antenna are easily affected by the reduction of the forehead area and the material of the casing, thereby improving the performance of the electronic device. In addition, the main antenna of this embodiment can be applied to different casings and color matching function (CMF) to enhance the applicable range of the antenna.

Figure 3:
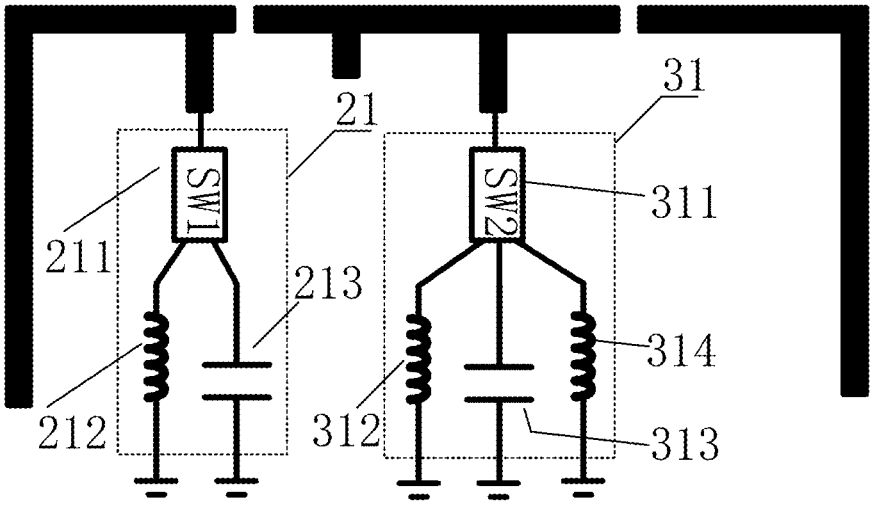
FIG. 3 illustrates a circuit diagram of a first switch module and a second switch module in the electronic device shown in FIG. 1.

In one embodiment, referring to FIG. 3, the first switch module 21 can include a first switch 211, a first inductor 212, and a first capacitor 213. A first switch end, which can be located at an upper portion of the first switch 211 of the first switch 211, as shown in FIG. 3, can be connected to the second connecting portion 18. A second switch end, which can be located at the left of a lower portion of the first switch SW1 of the first switch 211, as shown in FIG. 3, can be connected to a first switch end, which can be located at an upper portion of the first inductor 212 of the first inductor 212, as shown in FIG. 3, and a second switch end, which can be located at a lower portion of the first inductor 212 of the first inductor 212 shown in FIG. 3, can be grounded. Similarly, a third switch end, which can be located at the right of the lower portion of the first switch SW1 of the first switch 211, as shown in FIG. 3, can be connected to a first capacitor end, which can be located at an upper portion of the first capacitor 213 of the first capacitor 213, shown in FIG. 3, and a second capacitor end, which can be located at a lower portion of the first capacitor 213 of the first capacitor 213, as shown in FIG. 3, can be grounded.

In such an embodiment, the first switch 211 can be a mechanical switch such as a single-pole double-throw switch, or alternatively can also be provided as an electronic switch such as a relay. These optional switches are made for exemplary and enablement purposes only, wherein those having ordinary skill in the art will be able to select a suitable switch based on different applications, wherein such examples are not intended to be limiting to the scope of this disclosure. As such, the first switch in embodiments of the present disclosure is illustrated by an example of a controllable electronic switch.

In one embodiment, the first inductor 212 can employ an inductor with inductance of 24 nH. In such an embodiment a corresponding first capacitor 213 can employ a capacitor with capacitance of 3 pF. It should be noted that the values of the first inductor 212 and the first capacitor 213 are related to the size of the electronic device, the metal bezel, and the operating frequency band of the corresponding parasitic antenna. Based on these relationships, those skilled in the art can also choose the correct inductors or capacitors according to their specific application or otherwise obtain the first inductance or the first capacitance by means of multiple capacitors, inductors, and resistors connected in series or parallel with each other. As such, the solution of the present application can also be implemented and the corresponding solution also falls within the protection scope of the present application.

The working process of the first switch module 21 can be described as follows:

When the first switch 211 receives a control signal, for example, the control signal is 1, the first switch 211 is switched to be connected to the first inductor 212, so that the second connecting portion 18, the first switch 211, and the first inductor 212 form a first branch circuit connecting the second sub-bezel 12 and the ground (Gnd).

When the first switch 211 receives a control signal, for example, the control signal is 0, the first switch 211 is switched to be connected to the first capacitor 213, in this manner, the second connecting portion 18, the first switch 211, and the first capacitor 213 form a second branch circuit connecting the second sub-bezel 12 and the ground (Gnd).

In the present embodiment, by adjusting the first switch 211 to be connected to different components respectively, the effect of adjusting the impedance value of the first switch module 21 can be achieved.

Figure 4:
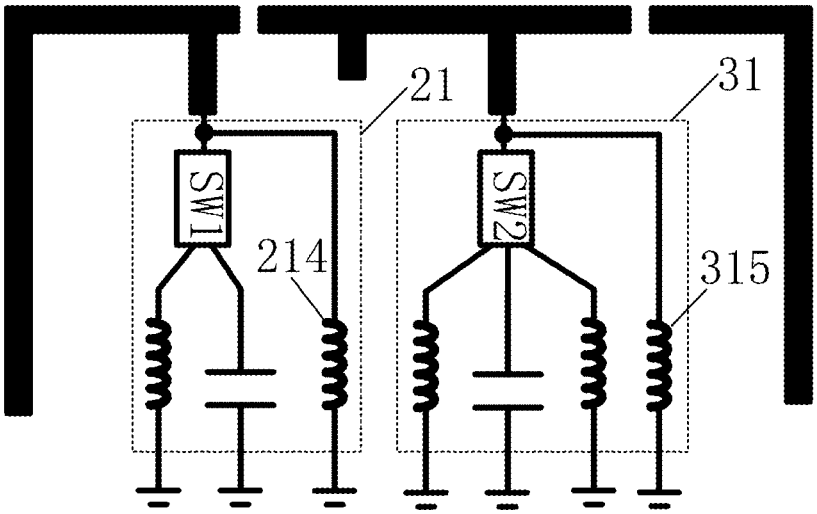
FIG. 4 illustrates another circuit diagram of a first switch module and a second switch module in the electronic device shown in FIG. 1.

Since the first switch 211 generates parasitic capacitance and insertion loss during the switch process, in an embodiment, referring to FIG. 4, the first switch module 21 further includes a second inductor 214. A first inductor end, which can be located at an upper portion of the second inductor 214) of the second inductor 214, as shown in FIG. 3, can be connected to the first end of the first switch 211, and a second inductor end of the second inductor 214 is grounded (Gnd). In this embodiment, the parasitic capacitance and the insertion loss of the first switch 211 can be reduced by providing the second inductor 214 having an appropriate inductance.

In an embodiment, with continuing reference to FIG. 3, the second switch module 31 can include a second switch 311, a third inductor 312, a second capacitor 313, and a fourth inductor 314. An alternative first switch end, which can be located at an upper portion of the second switch 311 of the second switch 311, as shown in FIG. 3, can be connected to the third connecting portion 19. An additional second switch end, which can be located at the left of a lower portion of the second switch SW2 of the second switch 311, as shown in FIG. 3, can be connected to an additional first inductor end which can be located at an upper portion of the third inductor 312) of the third inductor 312, and an additional second inductor end, which can be located at a lower portion of the third inductor 312 of the third inductor 312, as shown in FIG. 3, which can be grounded (Gnd).

In this embodiment, a third switch end, which can be located at the middle of the lower portion of the second switch SW2 of the second switch 311 can be connected to a first capacitor end, which can be located at an upper portion of the second capacitor 313 of the second capacitor 313, and a second capacitor end of the second capacitor 313, which can be grounded (Gnd). A fourth switch end, which can be located at right of the lower portion of the second switch SW2, of the second switch 311 can be connected to a first inductor end, which can be located at an upper portion of the fourth inductor 314 of the fourth inductor 314, and a second inductor end, which can be located at a lower portion of the fourth inductor 314 of the fourth inductor 314 which can be grounded, all of which is illustrated in FIG. 3.

In one embodiment, the third inductor 312 can employ an inductor having an inductance of 2.4 nH; the second capacitor 313 can employ a capacitor having a capacitance of 3.6 pF; and the fourth inductor 314 can employ an inductor having an inductance of 15 nH. It should be noted that the values of the third inductor 312, the second capacitor 313, and the fourth inductor 314 are related to the size of the electronic device, the metal bezel, and the operating frequency band of the corresponding parasitic antenna. Based on these relationships, those skilled in the art can also obtain the third inductor, the fourth inductor and the second capacitor as necessary and can also employ various alternative means of multiple capacitors, inductors and resistors connected in series or parallel with each other. In this manner, the solution of the present application can also be implemented and the corresponding solution in various combinations which would also fall within the protection scope of the present application.

The working process of the second switch module 31 can be described as follows:

when the second switch 311 receives a control signal, for example, the control signal is 2, the second switch 311 is switched to be connected to the third inductor 312, so that the third connecting portion 19, the second switch 311, and the third inductor 312 form a first branch circuit connecting the first sub-bezel 11 and the ground (Gnd);

when the second switch 311 receives a control signal, for example, the control signal is 1, the second switch 311 is switched to be connected to the second capacitor 313, so that the third connecting portion 19, the second switch 311, and the second capacitor 313 form a second branch circuit connecting the first sub-bezel 11 to the ground (Gnd);

when the second switch 311 receives a control signal, for example, the control signal is 0, the second switch 311 is switched to be connected to the fourth inductor 314, so that the third connecting portion 19, the second switch 311, and the fourth inductor 314 form a third branch circuit connecting the first sub-bezel 11 and the ground (Gnd).

In an embodiment, the second switch 311 can be a mechanical switch such as a single-pole double-throw switch, and can also be an electronic switch such as a relay. Those skilled in the art can select a suitable switch based on a particular application, and the examples illustrated herein are thus not intended to be limiting, but are made by way of example only. The second switch illustrated in the embodiments of the present disclosure are illustrated as controllable electronic switches.

It can be seen that in the present embodiment, by adjusting the second switch 311 to be connected to different components, the effect of adjusting the impedance value of the second switch module 31 can be achieved.

Similar to the first switch 211, the second switch 311 generates parasitic capacitance and insertion loss during the switching process. In an embodiment, referring to FIG. 4, the second switch module 31 can further include a fifth inductor 315. A first inductor end of the fifth inductor 315, which can be located at an upper portion of the fifth inductor 315 can be connected to the first switch end of the second switch 311, and a second inductor end of the fifth inductor 315 wherein the second inductor end can be grounded (Gnd). In this embodiment, the parasitic capacitance and the insertion loss of the second switch 311 can be reduced by providing the fifth inductor 315.

In one embodiment, the fifth inductor 315 can employ an inductor having an inductance of 5.0 nH. Again, and similarly, those skilled in the art can also obtain the fifth inductor by means of multiple capacitors, inductors, and resistors connected in series or parallel with each other. As such, any such solution can also be implemented and the corresponding solution would still fall within the protection scope of the present application.

Figure 5:
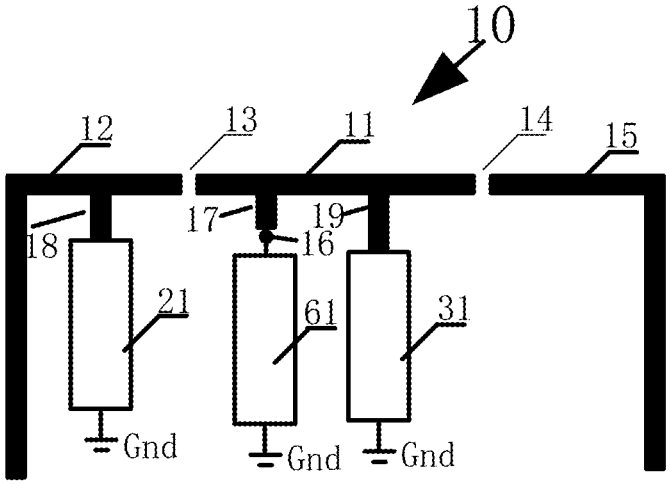
FIG. 5 illustrates a schematic diagram of a main antenna of an electronic device according to another exemplary embodiment.
Figure 6:
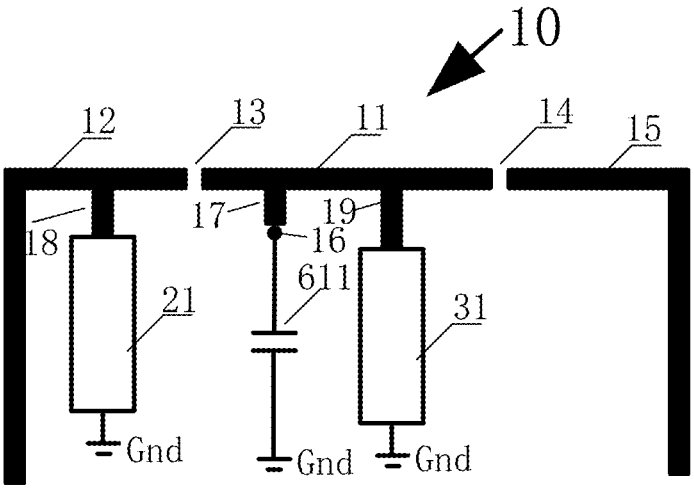
FIG. 6 illustrates a circuit diagram of a bandwidth optimization module in the electronic device shown in FIG. 5.

In yet another embodiment, in particular reference to FIG. 5, the electronic device 10 can also include a bandwidth optimization module 61. A first end of the bandwidth optimization module 61, which as shown in FIG. 5 can be located at an upper portion thereof, can be connected to the feeding point 16, and a second of the bandwidth optimization module 61 can be grounded (Gnd). In an embodiment, referring to FIG. 6, the bandwidth optimization module 61 can include: a variable capacitor 611, wherein the capacitance of the variable capacitor 611 can be implemented by a capacitor with an adjustment range of 1:4 or 1:5. If the adjustment range is 1:4, the capacitance can be 2 pF-8.2 pF. In this embodiment, by providing the bandwidth optimization module 61, the performance of each frequency band of the main antenna of the electronic device can be optimized.

Figure 7:
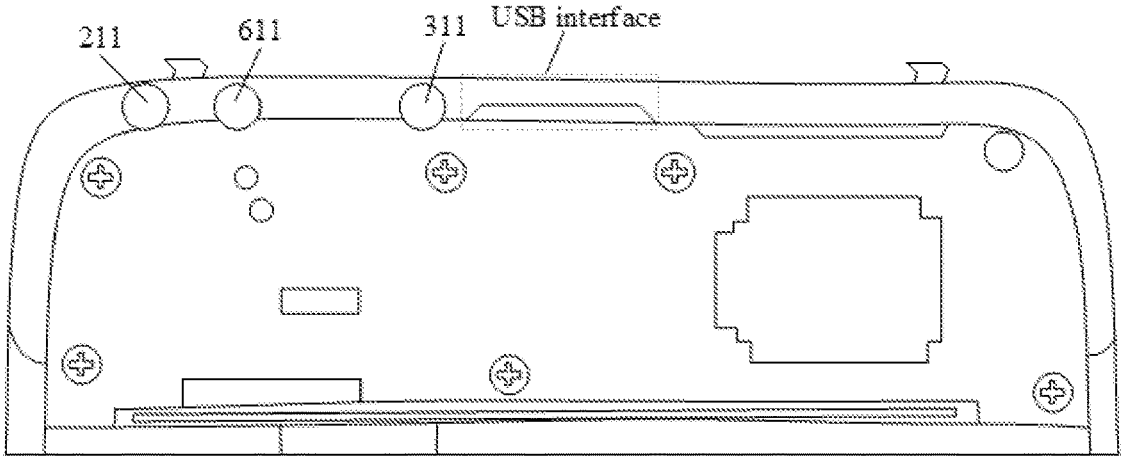
FIG. 7 illustrates a schematic diagram showing positions of providing a first switch and a second switch according to an exemplary embodiment.

In practical applications, referring to FIG. 7, the first switch 211, the variable capacitor 611, and the second switch 311 can be respectively disposed at corresponding positions about the upper left bezel of the back of the electronic device, the right side of the left partition, and the top bezel. It should be noted that the distance between the position of the second switch 311 and the position of the feeding point needs to have a sufficient electrical length so as to ensure reliable operation of the inverted F antenna 41. In some embodiments, the electronic device can also be provided with a USB interface at the bezel. In this case, the second switch 31 and the USB interface should be provided as close as possible so as to ensure the electrical length of the inverted F antenna is maximized.

In an embodiment, the electronic device 10 can further include a processor and a memory (not shown) which can be utilized so as to store the executable instructions to implemented by the processor. The processor can be connected to the corresponding control ends of the first switch module 21 and the second switch module 31. The control end of the first switch module 21 can then be connected to the control end of the first switch 211. Similarly, the control end of the second switch module 31 can be connected to the control end of the second switch 311. The processor can then be configured to retrieve and execute the executable instructions in the memory so as to adjust a switch state of the first switch module and the second switch module. In this manner the processor can be utilized in order to automatically adjust the impedance value of the first switch module and the second switch module.

For instance, the processor can also be utilized to determine a service type required to be performed by the electronic device, such as call, message, Internet, etc.; then determines the operating frequency band of the inverted F antenna and the parasitic antenna corresponding to the service type. The processor can then determine an appropriate switch state of both the first switch module and the second switch module based on the operating frequency band. Finally, the processor can be configured to adjust the both of the first switch module and the second switch module into an appropriate corresponding switch state.

Table 1 shows the correspondence between the operating frequency band of the electronic device and the switch states of the first switch and the second switch.

It should be noted that all-off means that the corresponding switch is disconnected, and all components in the corresponding switch module are disconnected. All-on means that the switch is connected with all components in the corresponding switch module.

TABLE 1

| Frequency Band | First Switch | Second Switch |
|---|---|---|
| B12 | 3.6 pF | 24 nH |
| GSM850 | all-off | 24 nH |
| GSM900 + B3 | 15 nH | 24 nH |
| 1.85~2.17 GHz | 2.4 nH | 24 nH |
| B40 | 3.6 pF | all-on |
| B41 | 2.4 nH | all-on |

Figure 8:
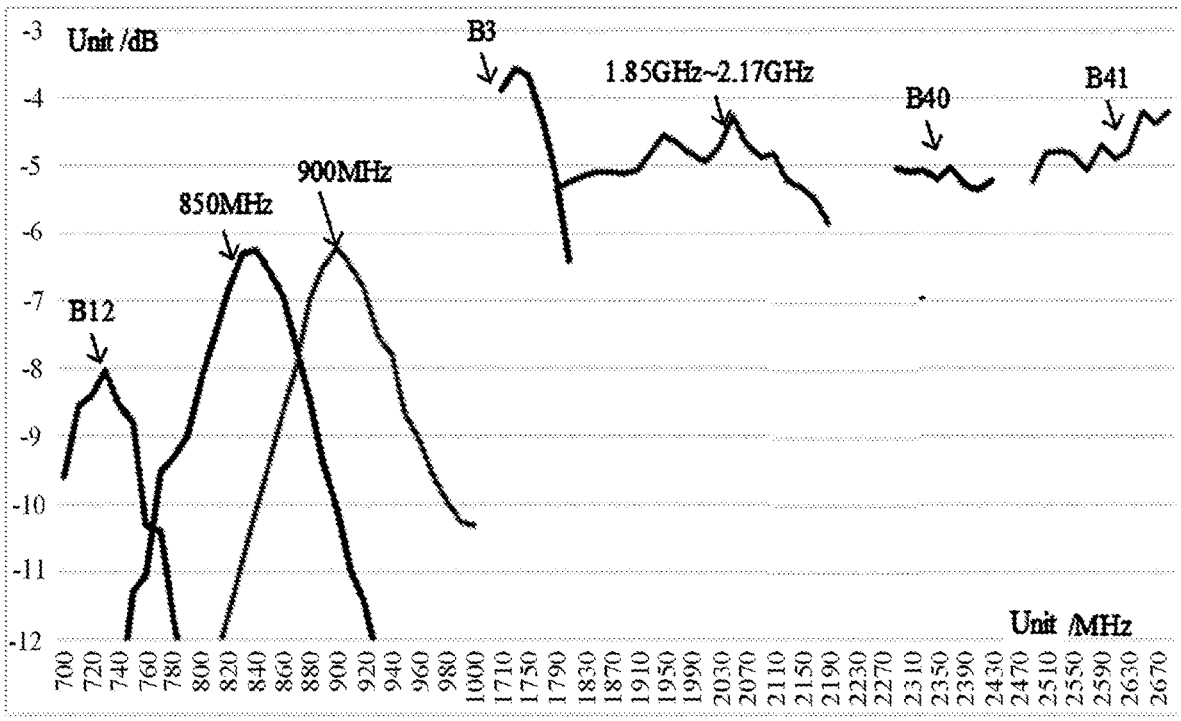
FIG. 8 illustrates a schematic diagram of operating frequency bands of an inverted-F antenna and a parasitic antenna according to an exemplary embodiment.

It can be seen from analysis of Table 1 that, in combination with FIG. 8, the correspondence between the operating frequency bands, i.e. of the inverted F antenna 41 and the parasitic antenna 51, and the switch states includes the following scenarios:

if the operating frequency band of the electronic device is the first frequency band (B12), the first switch 211 of the first switch module 21 is connected to the first inductor 212, and the second switch 311 of the second switch module 31 is connected to the second capacitor 313;

if the operating frequency band of the electronic device can be the second frequency band, for example GSM850, the first switch 211 can be connected to the first inductor 212, and the second switch 311 can be disconnected;

if the operating frequency band of the electronic device can be the third frequency band, for example GSM900+B3, the first switch 211 can be connected to the first inductor 212, and the second switch 311 can be connected to the third inductor 312;

if the operating frequency band of the electronic device can be the fourth frequency band, for example 1.85 GHz-2.17 GHz, the first switch 211 can be connected to the first inductor 212, and the second switch 311 can be connected to the fourth inductor 314;

if the operating frequency band of the electronic device can be the fifth frequency band, for example B40, the first switch 211 can be simultaneously connected to the first inductor 212 and the first capacitor 213, and the second switch 311 can be connected to the second capacitor 313; and if the operating frequency band of the electronic device can be the sixth frequency band, for example B41, the first switch 211 can be simultaneously connected to the first inductor 212 and the first capacitor 213, and the second switch 311 can be connected to the fourth inductor 314.

Figure 9:
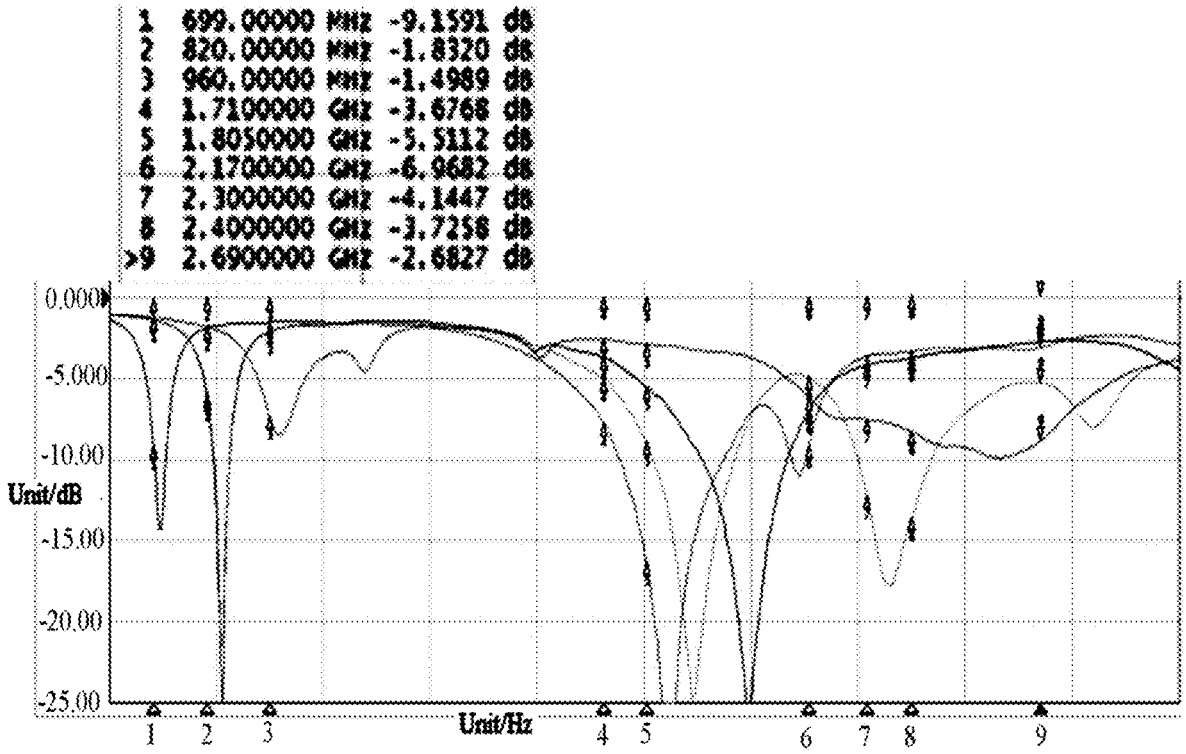
FIG. 9 illustrates a schematic diagram for simulating radiation efficiency of the inverted-F antenna and the parasitic antenna in different operating frequency bands.
Figure 10:
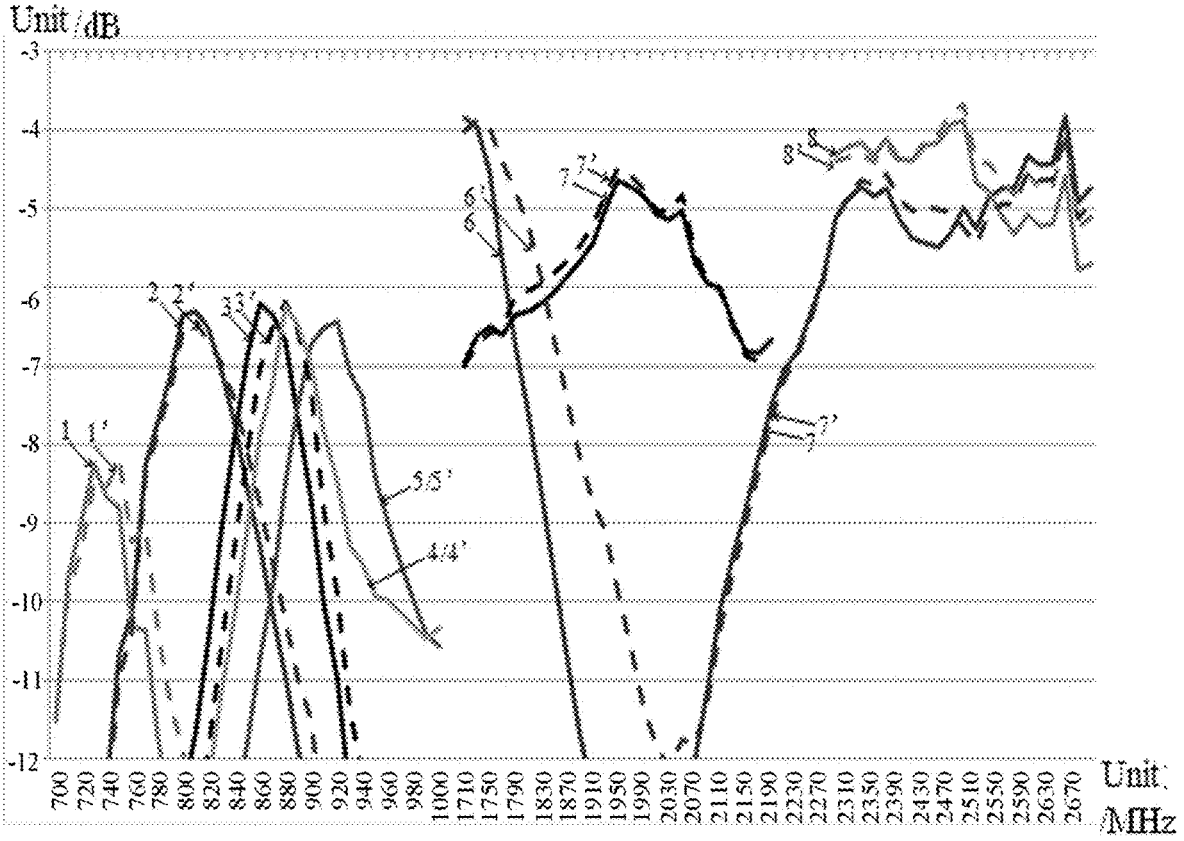
FIG. 10 illustrates a schematic diagram for simulating radiation efficiency of the inverted-F antenna and the parasitic antenna in different operating frequency bands when different materials are used in an electronic device.

After analysis by experiment and simulation, referring to FIG. 9, in this embodiment, the efficiency of the low frequency bands, for example 700 MHz band and 900 MHz band, can be between −6 dB and −8 dB, and the efficiency of other frequency bands can about −5 dB, which can satisfy actual demand of the electronic device. In addition, in this embodiment, referring to FIG. 10, the electronic device can utilize a ceramic casing and a glass casing, respectively. FIG. 10 shows the operating frequency band of the inverted F antenna 41 and the parasitic antenna 51, wherein the solid line corresponds to the ceramic casing, and the dotted line corresponds to the glass casing. In this situation, the number X and the number X' represent the same frequency band, and X takes an integer between 1 and 8. As illustrated here, it can be seen that when the casing material of the electronic device changes, the operating frequency band and the radiated efficiency of the inverted F antenna 41 and the parasitic antenna 51 are not greatly affected. That is to say, the main antenna setting scheme of the electronic device provided by the present embodiment can satisfy the requirement that the full screen antenna is reduced to 2.5 mm, and the range of application is relatively large.

Figure 11:
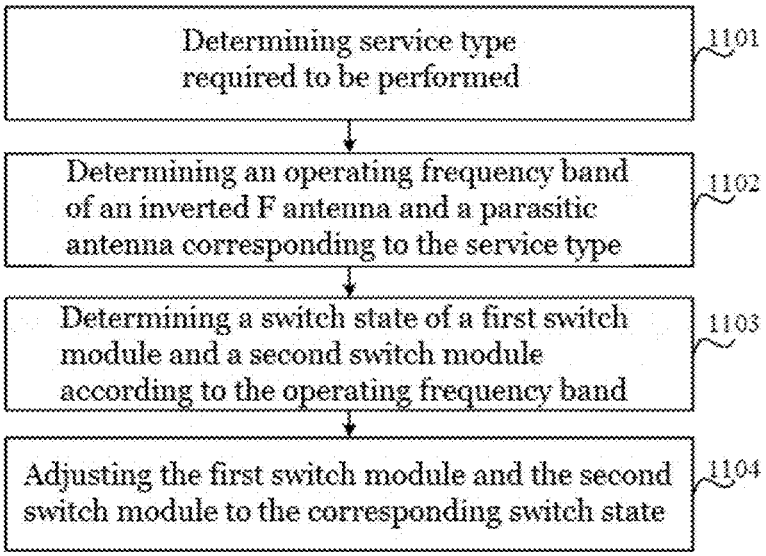
FIG. 11 illustrates a schematic flowchart diagram of a method for adjusting an operating frequency band of an antenna of an electronic device according to an exemplary embodiment.

In another aspect of the present disclosure, a method for adjusting operating frequency band of an antenna of an electronic device is contemplated, and in particular reference to FIG. 11, such a method can include the following steps; 1101-1104:

in step 1101, the method can include a step of: determining a service type required to be performed;

in step 1102, the method can include a step of: determining an operating frequency band of an inverted F antenna and a parasitic antenna corresponding to the service type;

in step 1103, the method can include a step of: determining a switch state of a first switch module and a second switch module according to the operating frequency band;

in step 1104, the method can include a step of: adjusting the first switch module and the second switch module to the corresponding switch state.

In this embodiment, during using the electronic device, the user can trigger different services, such as call, message, Internet, etc., and different services require the antenna of the electronic device to operate in different operating frequency bands. Therefore, the processor can determine service type to be performed according to the triggering operation of the user, and then determine the operating frequency band of the inverted F antenna and the parasitic antenna corresponding to the service type, and the switch states of the first switch module and the second switch module, and finally, according to the corresponding relationship between the service and the operating frequency band, the processor adjusts the first switch module and the second switch module to the corresponding switch states, see Table 1.

In an embodiment, determining a switch state of a first switch module and a second switch module based on the operating frequency band can include the following determinations and actions:

if the operating frequency band is a first frequency band (B12), determining that a first switch in the first switch module can be connected to a first inductor, and a second switch in the second switch module can be connected to a second capacitor;

if the operating frequency band is a second frequency band (GSM850), determining that the first switch is connected to the first inductor, and the second switch is disconnected;

if the operating frequency band is a third frequency band (GSM900+B3), determining that the first switch is connected to the first inductor, and the second switch is connected to a third inductor;

if the operating frequency band is a fourth frequency band (1.85-2.17 GHz), determining that the first switch is connected to the first inductor and the second switch is connected to a fourth inductor;

if the operating frequency band is the fifth frequency band (B40), determining that the first switch is simultaneously connected to the first inductor and a first capacitor, and the second switch is connected to the second capacitor; and if the operating frequency band is the sixth frequency band (B41), determining that the first switch is simultaneously connected to the first inductor and the first capacitor, and the second switch is connected to the fourth capacitor.

Figure 12:
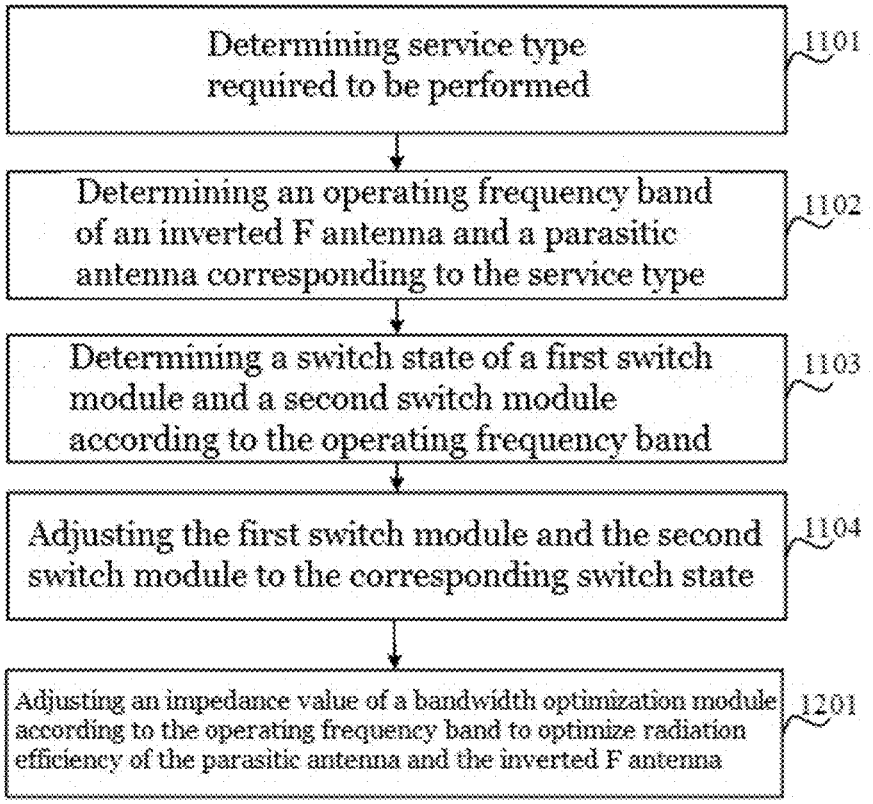
FIG. 12 illustrates another schematic flowchart diagram of a method for adjusting an operating frequency band of an antenna of an electronic device according to another exemplary embodiment.

In an embodiment, referring to FIG. 12, based on the method for adjusting operating frequency band of an antenna of an electronic device shown in FIG. 11, the method further includes step 1201.

In step 1201, the method can include the step of adjusting an impedance value of a bandwidth optimization module according to the operating frequency band to optimize radiation efficiency of the parasitic antenna and the inverted F antenna.

It should be noted that the method for adjusting operating frequency band of an antenna of an electronic device provided in this embodiment has been embodied in the process of describing the embodiment of the electronic device, and the related content of the device embodiment can be referred to, and details are not described herein again.

Figure 13:
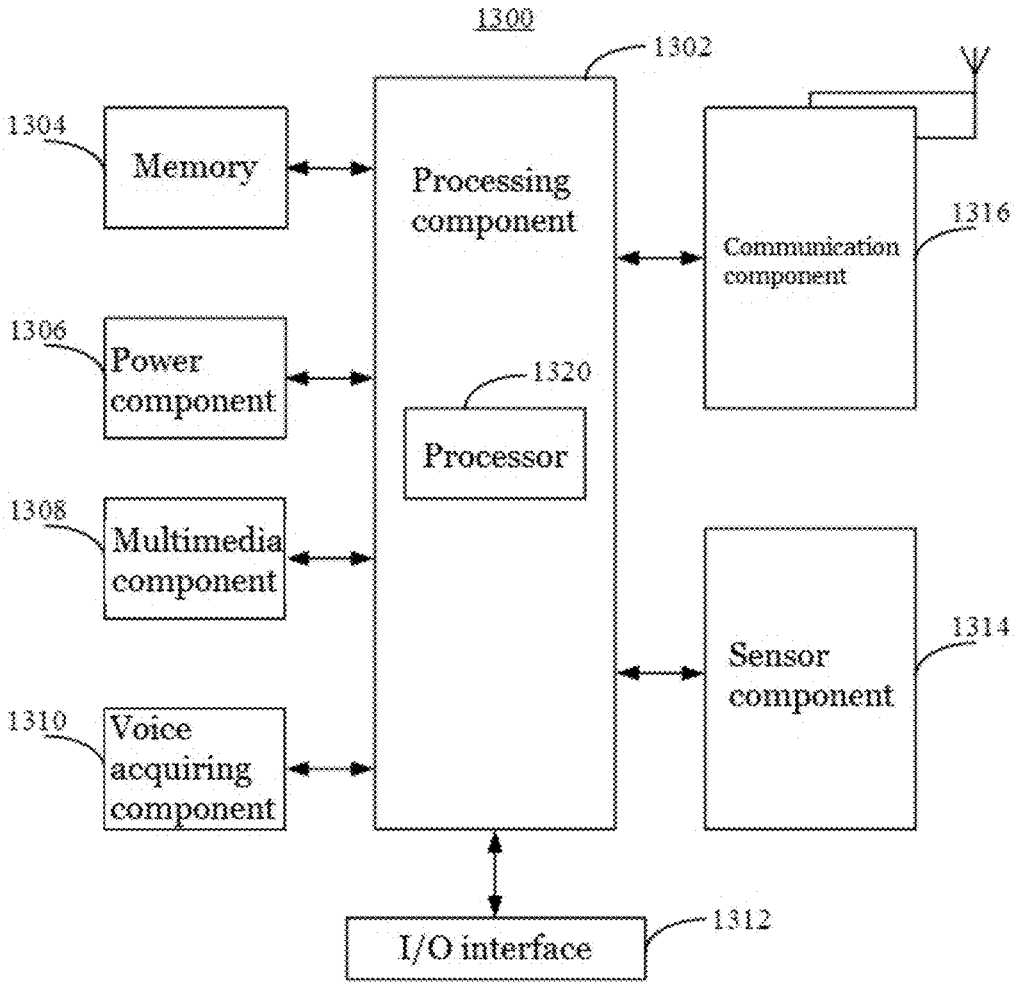
FIG. 13 illustrates a block diagram of an electronic device according to an exemplary embodiment.

FIG. 13 illustrates a block diagram of an electronic device according to another exemplary embodiment. For example, as illustrated here, the electronic device 1300 can be a mobile phone, a computer, a digital broadcast terminal, a message transceiver device, a gaming console, a tablet, a medical device, exercise equipment, a personal digital assistant, and the like.

Referring to FIG. 13, the electronic device 1300 can include one or more of the following components: a processing component 1302, a memory 1304, a power component 1306, a multimedia component 1308, a voice acquiring component 1310, an input/output (I/O) interface 1312, a sensor component 1314, and a communication component 1316. The memory 1304 can in such instances be utilized to store instructions executable by the processing component 1302. The processing component 1302 reads instructions from the memory 1304 and implements the instructions, which instructions can include the following steps:

determining service type required to be performed;

determining an operating frequency band of an inverted F antenna and a parasitic antenna corresponding to the service type;

determining a switch state of a first switch module;

determining a switch state of a second switch module according to the operating frequency band; and determining the first switch module and the second switch module to the corresponding switch state.

In such embodiments, the processing component 1302 typically controls overall operations of the electronic device 1300, such as the operations associated with display, telephone calls, data communications, camera operations, and recording operations. The processing component 1302 can also include one or more processors 1320 configured to execute instructions. Moreover, the processing component 1302 can include one or more modules which facilitate the interaction between the processing component 1302 and other components. For instance, the processing component 1302 can include a multimedia module to facilitate the interaction between the multimedia component 1308 and the processing component 1302.

In some additional embodiments, the memory 1304 can be configured to store various types of data to support the operation of the electronic device 1300. Examples of such data include instructions for any applications or methods operated on the electronic device 1300, contact data, phonebook data, messages, pictures, video, etc. The memory 1304 can be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1306, as illustrated herein, can be utilized so as to provide power to various components of the electronic device 1300. The power component 1306 can include a power management system, one or more power sources, and any other components associated with the generation, management, and distribution of power in the electronic device 1300.

The multimedia component 1308 can further include a screen configured to provide an output/input interface between the electronic device 1300 and the user. In some embodiments, the screen can include a liquid crystal display (LCD) and a touch panel (TP). If the screen includes the touch panel, the screen can be implemented as a touch screen to receive input signals from the user. The touch panel includes one or more touch sensors to sense touches, swipes, and gestures on the touch panel. The touch sensors can not only sense a boundary of a touch or swipe action, but also sense a period of time and a pressure associated with the touch or swipe action. In some embodiments, the multimedia component 1308 includes a front camera and/or a rear camera. The front camera and the rear camera can receive external multimedia data while the electronic device 1300 is in an operation mode, such as a photographing mode or a video mode. Each of the front camera and the rear camera can be a fixed optical lens system or have focus and optical zoom capability.

In some alternative embodiments, the electronic device can include a voice acquiring component 1310 which can be configured to output and/or input audio signals. For example, the voice acquiring component 1310 can include a microphone ("MIC") configured to receive an external audio signal when the electronic device 1300 is in an operation mode, such as a call mode, a recording mode, and a voice recognition mode. The received audio signal can be further stored in the memory 1304 or transmitted via the communication component 1316. In some embodiments, the audio component 1310 further includes a speaker to output audio signals.

In some additional embodiments the electronic device can further include an I/O interface 1312 configured to provide an interface between the processing component 1302 and peripheral interface modules, such as a keyboard, a click wheel, buttons, and the like. The buttons can include, but are not limited to, a home button, a volume button, a starting button, and a locking button.

In some additional embodiments the electronic device can further include a sensor component 1314 which can include one or more sensors configured to provide status assessments of various aspects of the electronic device 1300. For instance, the sensor component 1314 can detect an on/off status of the electronic device 1300, relative positioning of components (e.g., the display and the keypad of the electronic device 1300), a change of position of the electronic device 1300 or a component of the electronic device 1300, a presence or absence of user contact with the electronic device 1300, an orientation or an acceleration/deceleration of the electronic device 1300, and a change of temperature of the electronic device 1300. The sensor component 1314 can include a proximity sensor configured to detect the presence of nearby objects without any physical contact. The sensor component 1314 can also include a light sensor, such as a CMOS or CCD image sensor, for use in imaging applications. In some embodiments, the sensor component 1314 can also include an accelerometer sensor, a gyroscope sensor, a magnetic sensor, a pressure sensor, or a temperature sensor.

In some additional embodiments the electronic device can further include a communication component 1316 which can be configured to facilitate communication, wired or wirelessly, between the electronic device 1300 and other devices. The electronic device 1300 can access a wireless network based on a communication standard, such as Wi-Fi, 2G, or 3G, or a combination thereof. In one exemplary embodiment, the communication component 1316 receives a broadcast signal or broadcast associated information from an external broadcast management system via a broadcast channel. In one exemplary embodiment, the communication component 1316 further includes a near field communication (NFC) module to facilitate short-range communications. For example, the NFC module can be implemented based on a radio frequency identification (RFID) technology, an infrared data association (IrDA) technology, an ultra-wideband (UWB) technology, a Bluetooth (BT) technology, or other technologies.

In exemplary embodiments, the electronic device 1300 can be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components.

In exemplary embodiments, there is also provided a non-transitory computer-readable storage medium including instructions, such as the memory 1304 including instructions, wherein the instructions are executable by the processor 1320 in the electronic device 1300. For example, the non-transitory computer-readable storage medium can be a ROM, a RAM, a CD-ROM, a magnetic tape, a floppy disc, an optical data storage device, and the like.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

The invention claimed is:

1. An electronic device, comprising:

a bezel, the bezel being formed from a first partition and a second partition, the first partition and the second partition dividing the bezel into a first sub-bezel and a second sub-bezel; wherein the first sub-bezel is located between the first partition and the second partition; characterized in that the electronic device further comprises:

a feeding point;

a first switch module;

a second switch module;

a first connecting portion;

a second connecting portion; and a third connecting portion;

wherein the feeding point is connected to an end of the first sub-bezel through the first connecting portion;

wherein a first end of the first switch module is connected to the second partition through the second connecting portion, and a second end of the first switch module is grounded;

wherein a connection position between the second connecting portion and the second partitioning is close to the feeding point;

wherein a first end of the second switch module is connected to the first sub-bezel through the third connecting portion, and a second end of the second switch module is grounded;

wherein, the feeding point, the first connecting portion, the first sub-bezel, the third connecting portion and the second switch module form an inverted F antenna; and wherein the second sub-bezel, the second connecting portion and the first switch module form a parasitic antenna of the inverted F antenna;

wherein the electronic device further comprises:

a bandwidth optimization module;

wherein a first end of the bandwidth optimization module is connected to the feeding point, and a second end of the bandwidth optimization module is grounded.

2. The electronic device according to claim 1, wherein the first switch module further comprises:

a first switch;

a first inductor; and a first capacitor;

wherein a first end of the first switch is connected to the second connecting portion;

wherein a second end of the first switch is connected to a first end of the first inductor, and a second end of the first inductor is grounded; and wherein a third end of the first switch is connected to a first end of the first capacitor, and a second end of the first capacitor is grounded.

3. The electronic device according to claim 2, wherein the first switch module further comprises:

a second inductor;

wherein a first end of the second inductor is connected to the first end of the first switch, and a second end of the second inductor is grounded.

4. The electronic device according to claim 1, wherein the second switch module further comprises:

a second switch;

a second capacitor;

a third inductor; and a fourth inductor;

wherein a first end of the second switch is connected to the third connecting portion;

wherein a second end of the second switch is connected to a first end of the third inductor, and a second end of the third inductor is grounded;

wherein a third end of the second switch is connected to a first end of the second capacitor, and a second end of the second capacitor is grounded; and wherein a fourth end of the second switch is connected to a first end of the fourth inductor, and a second end of the fourth inductor is grounded.

5. The electronic device according to claim 4, wherein the second switch module further comprises:

a fifth inductor;

wherein a first end of the fifth inductor is connected to the first end of the second switch, and a second end of the fifth inductor is grounded.

6. The electronic device according to claim 1, wherein the bandwidth optimization module comprises:

a variable capacitor;

wherein a first end of the variable capacitor is connected to the feeding point, and a second end of the variable capacitor is grounded.

7. The electronic device according to claim 1, wherein the electronic device further comprises:

a processor; and a memory device configured to store processor-executable instructions;

wherein the processor is connected to control ends of the first switch module and the second switch module; and wherein the processor is configured to execute the executable instructions stored in the memory to adjust a switch state of the first switch module and a switch state of the second switch module through corresponding control ends.

8. A method for adjusting an operating frequency band of an antenna of an electronic device, wherein, the method comprises:

determining service type required to be performed;

determining an operating frequency band of an inverted F antenna and a parasitic antenna corresponding to the service type;

determining a switch state of a first switch module and a second switch module according to the operating frequency band; and adjusting the first switch module and the second switch module to corresponding switch state.

9. The method according to claim 8, wherein the determining a switch state of a first switch module and a second switch module according to the operating frequency band comprises:

wherein if the operating frequency band is a first frequency band, determining that a first switch in the first switch module is connected to a first inductor, and a second switch in the second switch module is connected to a second capacitor;

wherein if the operating frequency band is a second frequency band, determining that the first switch is connected to the first inductor, and the second switch is disconnected;

wherein if the operating frequency band is a third frequency band, determining that the first switch is connected to the first inductor, and the second switch is connected to a third inductor;

wherein if the operating frequency band is a fourth frequency band, determining that the first switch is connected to the first inductor, and the second switch is connected to a fourth inductor;

wherein if the operating frequency band is a fifth frequency band, determining that the first switch is simultaneously connected to the first inductor and a first capacitor, and the second switch is connected to the second capacitor; and wherein if the operating frequency band is a sixth frequency band, determining that the first switch is simultaneously connected to the first inductor and the first capacitor, and the second switch is connected to the fourth inductor.

10. The method according to claim 8, wherein the method further comprises:

adjusting, according to the operating frequency band, an impedance value of a bandwidth optimization module to optimize radiation efficiency of the parasitic antenna and the inverted F antenna.

11. An electronic device, comprising:

a bezel, the bezel being formed from a first partition and a second partition, the first partition and the second partition dividing the bezel into a first sub-bezel and a second sub-bezel; wherein the first sub-bezel is located between the first partition and the second partition; characterized in that the electronic device further comprises:

a feeding point;

a first switch module further comprising:

a first switch;

a first inductor;

a first capacitor; and a second inductor;

a second switch module further comprising:

a second switch;

a second capacitor;

a third inductor; and a fourth inductor;

a first connecting portion;

a second connecting portion;

a third connecting portion;

a processor; and a non-transitory computer-readable medium for storing processor executable instructions;

wherein the feeding point is connected to an end of the first sub-bezel through the first connecting portion;

wherein a first end of the first switch module is connected to the second partition through the second connecting portion, and a second end of the first switch module is grounded;

wherein a connection position between the second connecting portion and the second partitioning is close to the feeding point;

wherein a first end of the second switch module is connected to the first sub-bezel through the third connecting portion, and a second end of the second switch module is grounded;

wherein, the feeding point, the first connecting portion, the first sub-bezel, the third connecting portion and the second switch module form an inverted F antenna;

wherein the second sub-bezel, the second connecting portion and the first switch module form a parasitic antenna of the inverted F antenna;

wherein a first end of the first switch is connected to the second connecting portion;

wherein a second end of the first switch is connected to a first end of the first inductor, and a second end of the first inductor is grounded;

wherein a third end of the first switch is connected to a first end of the first capacitor, and a second end of the first capacitor is grounded;

wherein a first end of the second inductor is connected to the first end of the first switch, and a second end of the second inductor is grounded;

wherein a first end of the second switch is connected to the third connecting portion;

wherein a second end of the second switch is connected to a first end of the third inductor, and a second end of the third inductor is grounded;

wherein a third end of the second switch is connected to a first end of the second capacitor, and a second end of the second capacitor is grounded; and wherein a fourth end of the second switch is connected to a first end of the fourth inductor, and a second end of the fourth inductor is grounded;

wherein the processor is connected to control ends of the first switch module and the second switch module; and wherein the processor is configured to execute the executable instructions stored in the memory to adjust a switch state of the first switch module and a switch state of the second switch module through corresponding control ends.

12. The electronic device according to claim 11, wherein the second switch module further comprises:

a fifth inductor;

wherein a first end of the fifth inductor is connected to the first end of the second switch, and a second end of the fifth inductor is grounded.

13. The electronic device according to claim 11, wherein the electronic device further comprises:

a bandwidth optimization module;

wherein a first end of the bandwidth optimization module is connected to the feeding point, and a second end of the bandwidth optimization module is grounded.

14. The electronic device according to claim 11, wherein the bandwidth optimization module comprises:

a variable capacitor;

wherein a first end of the variable capacitor is connected to the feeding point, and a second end of the variable capacitor is grounded.

15. The electronic device according to claim 11, wherein the non-transitory computer readable medium includes executable instructions for instructing the processor to perform the following tasks:

determining service type required to be performed;

determining an operating frequency band of an inverted F antenna and a parasitic antenna corresponding to the service type;

determining a switch state of a first switch module and a second switch module according to the operating frequency band; and adjusting the first switch module and the second switch module to corresponding switch state.

16. The electronic device according to claim 15, wherein the non-transitory computer readable medium includes executable instructions for instructing the processor to perform the following tasks:

wherein if the operating frequency band is a first frequency band, determining that a first switch in the first switch module is connected to a first inductor, and a second switch in the second switch module is connected to a second capacitor;

wherein if the operating frequency band is a second frequency band, determining that the first switch is connected to the first inductor, and the second switch is disconnected;

wherein if the operating frequency band is a third frequency band, determining that the first switch is connected to the first inductor, and the second switch is connected to a third inductor;

wherein if the operating frequency band is a fourth frequency band, determining that the first switch is connected to the first inductor, and the second switch is connected to a fourth inductor;

wherein if the operating frequency band is a fifth frequency band, determining that the first switch is simultaneously connected to the first inductor and a first capacitor, and the second switch is connected to the second capacitor; and wherein if the operating frequency band is a sixth frequency band, determining that the first switch is simultaneously connected to the first inductor and the first capacitor, and the second switch is connected to the fourth inductor.

17. The electronic device according to claim 15, wherein the non-transitory computer readable medium includes executable instructions for instructing the processor to perform the following tasks:

adjusting, according to the operating frequency band, an impedance value of a bandwidth optimization module to optimize radiation efficiency of the parasitic antenna and the inverted F antenna.

18. The electronic device according to claim 17, wherein the bezel is a metal bezel.

* * * * *